US007178896B2

(12) United States Patent
Strecker et al.

(10) Patent No.: US 7,178,896 B2
(45) Date of Patent: Feb. 20, 2007

(54) ARTICLE OF MANUFACTURE INCLUDING A TWO-PART ADHESIVE WITH A FLUORESCENT DYE AND METHOD OF MAKING

(75) Inventors: Timothy D. Strecker, Corvallis, OR (US); Lawrence E Gibson, San Diego, CA (US); M. Timothy Smith, Kent, OH (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 373 days.

(21) Appl. No.: 10/353,631

(22) Filed: Jan. 29, 2003

(65) Prior Publication Data

US 2004/0145620 A1 Jul. 29, 2004

(51) Int. Cl.
*B41J 2/015* (2006.01)

(52) U.S. Cl. ..... 347/20

(58) Field of Classification Search ..... 347/20, 347/40, 44, 49; 156/64, 67, 273.3; 428/913; 430/270.1; 250/461.1, 459.1; 427/8–10, 427/160

See application file for complete search history.

(56) References Cited

U.S. PATENT DOCUMENTS 3,675,015 A 7/1972 Geib
4,435,160 A * 3/1984 Randklev ..... 433/9
4,616,265 A * 10/1986 Lyden ..... 348/829
4,778,999 A 10/1988 Fisher
4,814,198 A 3/1989 Baecklund
4,922,113 A 5/1990 Melancon
5,030,833 A 7/1991 Nozaka et al.
5,079,098 A * 1/1992 Liu ..... 428/522
5,391,414 A 2/1995 Doering et al.
6,326,414 B1 12/2001 Iida
6,610,605 B2 * 8/2003 Rowlette et al. ..... 438/700
6,689,826 B2 * 2/2004 Wojciak ..... 524/107

FOREIGN PATENT DOCUMENTS

EP 1213695 A2 6/2002
WO WO98/29709 7/1998

* cited by examiner

*Primary Examiner*—Shih-Wen Hsieh

(57) ABSTRACT

An article of manufacture including a first adherend and a two-part adhesive mixed and dispensed on the first adherend, wherein the first part of the two-part adhesive includes a first fluorescent dye. The article of manufacture further includes a second adherend in contact with the two-part adhesive.

68 Claims, 8 Drawing Sheets

ARTICLE OF MANUFACTURE INCLUDING A TWO-PART ADHESIVE WITH A FLUORESCENT DYE AND METHOD OF MAKING

BACKGROUND

Description of the Art

Over the past ten to twenty years, the growth in the use of adhesives has been rapid, especially in ever more technically demanding applications such as in the aerospace, auto, and electronics industries. In addition, many major developments in the technology of adhesives have been accomplished during this time. For example, in the aerospace industry today much of the fuselage, the wing structure, interior components, and even the engine housing are at least partially adhesively bonded. In the auto industry, adhesives are also extensively used from bonding door panels, installing windshields, to even bonding parts inside the engine such as studs used to secure the inlet manifold to the cylinder head. Finally, the use of adhesives in the electronics industry has seen tremendous growth in mounting both integrated circuit chips, as well as, passive devices, such as resistors, capacitors, and inductors to printed circuit boards and other packaging technologies.

Adhesive bonding is an alternative to the more traditional mechanical fastening methods of joining materials, such as nails, screws, and rivets. One of the major differences between an adhesive joint and mechanical fastening is that, generally, in mechanical fastening one or both of the parts or materials being held together must be pierced by the mechanical fastener; whereas an adhesive joint may be formed without the need to pierce the materials. This leads to one of the advantages of adhesives over mechanical fastening, namely the ability to, not only fasten different materials, but to also seal the assembly in one step. Mechanical fastening typically requires separate sealing and fastening steps to create a sealed part. For example, in the area of microfluidics the utilization of separate mechanical fasteners and sealants or gaskets would typically result in larger, more expensive, and less efficient devices compared to that obtainable using an adhesive to both fasten and seal the device. Adhesives also provide an advantage in fastening dissimilar materials together, both from the standpoint of fastening materials such as glasses, ceramics, and silicon devices, in which forming the holes to allow fasteners to be utilized is difficult and expensive, as well as, joining materials that interact with each other such as mechanically fastening aluminum and steel together, which typically produces corrosion problems.

However, adhesive joints, by their nature, are internal to the joint, and thus, typically it is not easy to determine whether the adhesive was properly applied; in contrast to mechanical fastening where it is relatively straight forward to non-destructively test whether the fastener has been applied. In one case, this lack of non-destructive quality control can lead to higher scrap rates and thus higher cost, when a part or assembly is determined to be defective, in further down stream processing. In other cases it can lead to failure in the field leading to warranty repair or dissatisfied customers switching to a competitors product.

If these problems persist, the continued growth and advancements in the use adhesives in various assemblies, seen over the past several decades, will be reduced. In areas like consumer electronics, the demand for cheaper, smaller, more reliable, higher performance devices constantly puts pressure on improving and developing cheaper, faster and more reliable manufacturing processes. The ability to optimize the dispensing of adhesives, will open up a wide variety of applications that are currently either impractical or are not cost effective.

DESCRIPTION OF THE PREFERRED EMBODIMENTS

Figure 1A:
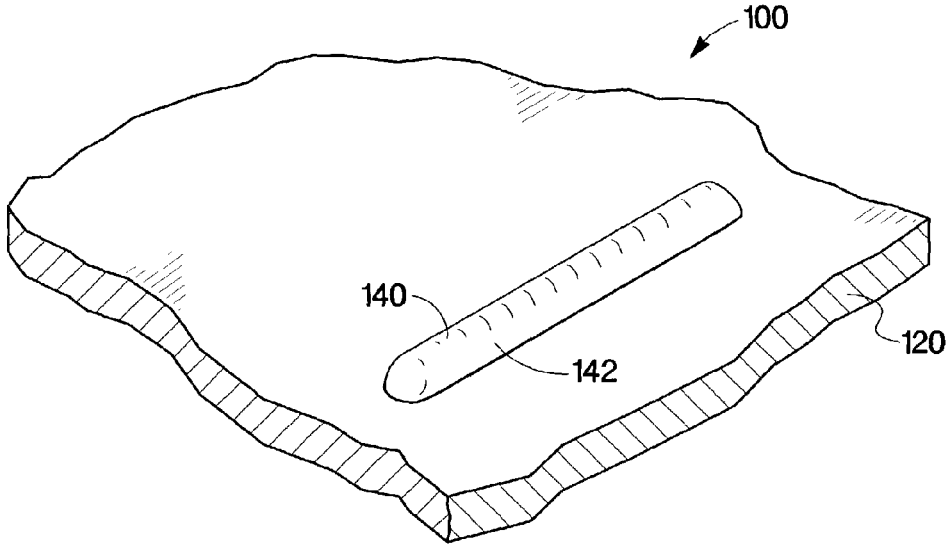
FIG. 1*a* is a perspective view of a two-part adhesive dispensed on an adherend of an article of manufacture according to an embodiment of the present invention.
Figure 1B:
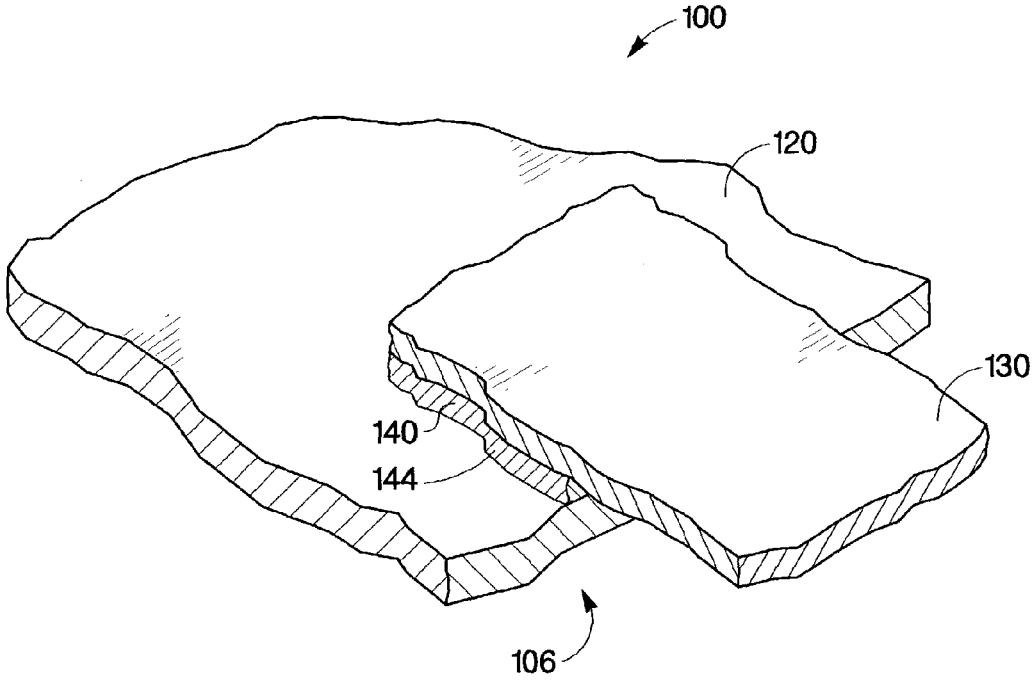
FIG. 1*b* is a perspective view of a second adherend urged toward the adherend shown in FIG. 1*a* according to an embodiment of the present invention.

Referring to FIGS. 1*a*–1*b*, an embodiment of the present invention is shown in a simplified perspective view. In this embodiment, article of manufacture 100, is shown in FIG. 1*a*, includes two-part adhesive 140 disposed on first adherend 120 as adhesive bead 142. The first part of two-part adhesive 140 includes a fluorescent dye that is utilized to determine what is commonly referred to as the degree of mixing between the first and second parts, and will be explained in greater detail later in this text. Briefly, prior to dispensing, the appropriate ratio of the first part and the second part of two-part adhesive 140 are mixed; the mixed two-part adhesive 140 is dispensed onto first adherend 120, and at least a portion of adhesive bead 142 is illuminated with ultraviolet light (UV light) causing the fluorescent dye in the first part of two-part adhesive 140 to fluoresce. The fluorescent signal is then utilized to determine the degree of mixing between the first and the second part of the two-part adhesive 140. After the degree of mixing is determined, for those adherends that do not transmit UV light, second adherend 130 is urged toward first adherend 120 to form bonded structure 106 having adhesive thickness 144 between first adherend 120 and second adherend 130 as shown in FIG. 1*b*. Depending on the particular application in which article of manufacture 100 is to be utilized in, for those adherends that do transmit UV and visible light, second adherend 130 may be urged toward first adherend 120 to form bonded structure 106 before the degree of mixing is determined.

In this embodiment, two-part adhesive 140 may be any two part adhesive such as two-part epoxies, polyurethanes, polynorbornenes, polysulfides and silicone adhesives, to name a few. The particular two-part adhesive utilized will depend on the particular application article of manufacture 100 will be utilized in, as well as, various factors such as reworkability, cost, environment the article will be exposed to, storage life and conditions, among others. In addition, a wide variety of fluorescing dyes may also be utilized in the first part such as 1-naphthol, 2-napthol, benzo{a}pyrene, benzanthrone (i.e.7H-Benz{de}anthracen-7-one), fluorscein, In addition, various inorganic fluorescers such as rare-earth oxides as for example Y2O3:Eu, and La2O2S:Eu may also be utilized. In this embodiment, the amount of fluorescent dye added to the first part of two-part adhesive 140 is in the range of from about 0.001 weight percent to about 1.0 weight percent. In alternate embodiments, the amount of fluorescent dye is in the range of from about 0.01 weight percent to about 0.5 weight percent.

It should be noted that the drawings are not true to scale. Further, various elements have not been drawn to scale. Certain dimensions have been exaggerated in relation to other dimensions in order to provide a clearer illustration and understanding of the present invention.

In addition, although some of the embodiments illustrated herein are shown in two dimensional views with various regions having depth and width, it should be clearly understood that these regions are illustrations of only a portion of a device that is actually a three dimensional structure. Accordingly, these regions will have three dimensions, including length, width, and depth, when fabricated on an actual device. Moreover, while the present invention is illustrated by various embodiments, it is not intended that these illustrations be a limitation on the scope or applicability of the present invention. Further it is not intended that the embodiments of the present invention be limited to the physical structures illustrated. These structures are included to demonstrate the utility and application of the present invention to presently preferred embodiments.

Figure 2:
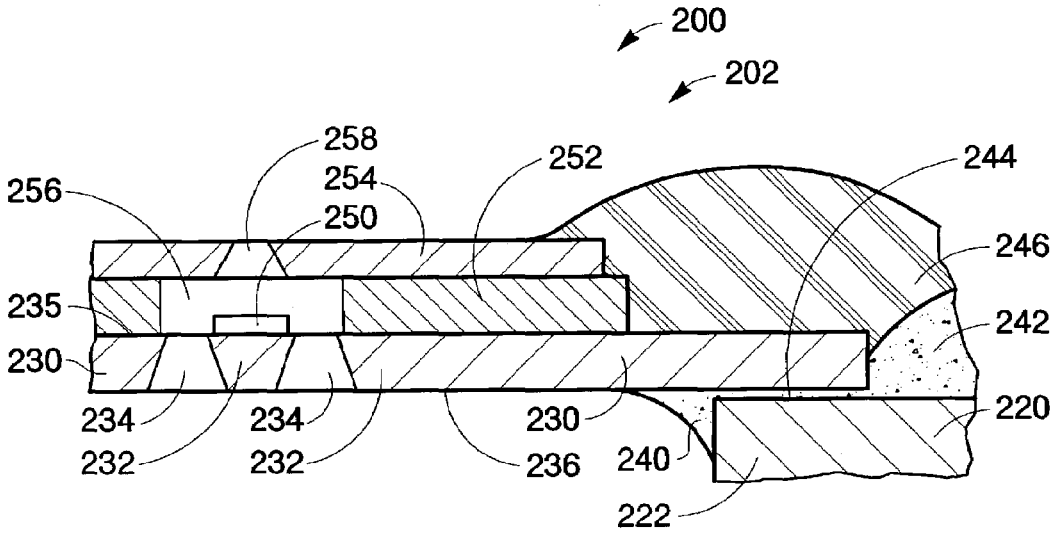
FIG. 2 is a cross-sectional view of a portion of a fluid ejector head according to an alternate embodiment of the present invention.

Referring to FIG. 2, an alternate embodiment of the present invention is shown in a simplified cross-sectional view. In this embodiment, article of manufacture 200 is fluid ejector head 202 where first adherend 220 is plastic fluid ejector cartridge body 222 and second adherend 230 is silicon die 232. In this embodiment, two-part adhesive 240 is a thermally cured two-part epoxy, however in alternate embodiments other two part adhesives such as polyurethanes, polynorbornenes, polysulfides and silicone adhesives, to name a few may also be utilized. The thermally cured two-part adhesive includes a first part commonly referred to as the resin having a first fluorescent dye added to it, and a second part commonly referred to as the hardener having a second fluorescent dye. The first and second fluorescent dyes are different wherein the peak emission characteristics of the two dyes are separately detectable. Adhesive thickness 244 is in the range from about 200 micrometers to about 1000 micrometers, in this embodiment. However, in alternate embodiments, adhesive thickness 244 may be in the range from about 10 microns to 1000 microns depending on the particular application in which fluid ejector head 202 will be utilized. Further, in this embodiment adhesive bead 242 is dispensed on fluid ejector cartridge body 220, however, depending on the particular pen body material utilized, as well as the particular two-part adhesive used, adhesive bead 242 may be dispensed on silicon die 232 in alternate embodiments. Adhesive bead 242 provides both a method of attachment and a fluid seal between silicon die 232 and fluid ejector cartridge body 220. After adhesive bead 242 is dispensed the degree of mixing can be measured as described in the embodiment shown in FIGS. 1*a*–1*b*.

Silicon die 232 has fluid ejector actuator 250 formed on device surface 235. In addition, electronic components and electrical circuits are formed on device surface 235. In this embodiment, silicon die 232 includes one or more transistors or other logic devices (not shown) formed on device surface 235, however, "direct drive" structures may also be utilized in alternate embodiments. In a direct drive application each fluid ejector is electrically connected to a bond pad (not shown). In direct drive applications, second adherend 230 may be formed from any material suitable for forming fluid ejector actuator 250 such as, for example, glass, ceramic, or polymer substrates. In this embodiment, silicon die 232 is a silicon integrated circuit including transistors and other logic devices (not shown), however, materials such as germanium, gallium arsenide, amorphous silicon, polysilicon, and other substrates such as glass, ceramic or polymer substrates that support active and passive devices may also be utilized.

As shown in FIG. 2, fluid ejector actuator 250 is a thermal resistor; however, other fluid ejectors may also be utilized such as piezoelectric, flex-tensional, acoustic, and electrostatic. Chamber layer 252 forms fluidic chamber 256 around fluid ejector actuator 250, so that when fluid ejector actuator 250 is activated, fluid is ejected out of nozzle 258, which is generally located over fluid ejector actuator 250. Fluid channels 234 formed in silicon die 232 provide a fluidic path for fluid in a reservoir (See FIG. 4) to fill fluidic chamber 256. Nozzle layer 254 is formed over chamber layer 252. Nozzle layer 254 may be formed of metal, polymer, glass, or other suitable material such as ceramic. For example, a photodefinable polymer such as photodefinable polyimides, benzocyclobutenes, or epoxies can be utilized to form both nozzle layer 254 and chamber layer 252. In addition, in still other embodiments nozzle layer 254 can also be formed from a metal such as a nickel base enclosed by a thin gold, palladium, tantalum, or rhodium layer. Further, in this embodiment, encapsulant 246 may also utilize a two-part adhesive providing mechanical support, as well as, moisture and corrosion protection to electrical interconnections, bond pads, and electrical traces between fluid ejector cartridge body 222 and silicon die 232. For example, a fluorescent dye may be added to the first part of a two-part adhesive utilized to form encapsulant 246. The first and second parts are metered in the desired proportions or weights and then are mixed. After mixing is completed the mixed two-part adhesive is dispensed to form encapsulant 246. Encapsulant 246 may then be illuminated with UV light and the fluorescent signal, from the fluorescent dye added to the first part of the two part adhesive, may then be analyzed to determine both the accuracy of metering the desired quantity, as well as, the thoroughness of the mixing process. In an alternate embodiment, this process may also be carried out on adhesive bead 242.

Figure 3:
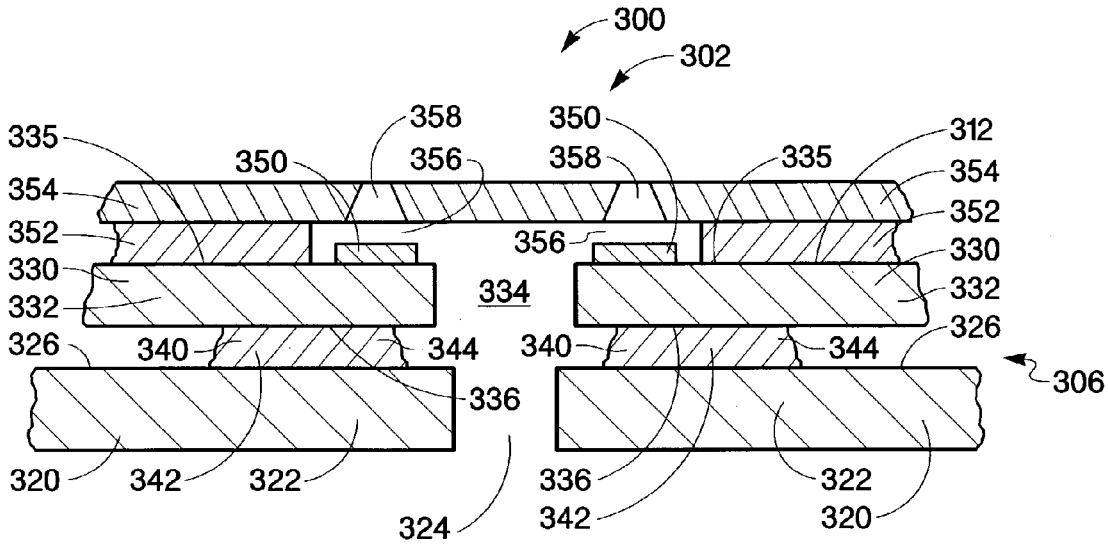
FIG. 3 is a cross-sectional view of a portion of a fluid ejector head according to an alternate embodiment of the present invention.

Referring to FIG. 3, an alternate embodiment, of the present invention is shown in a simplified cross-sectional view. In this embodiment, article of manufacture 300 is fluid ejector head 302 where first adherend 320 is ceramic chip carrier 322 and second adherend 330 is silicon die 332. Two-part adhesive 340 forms bonded structure 306 having adhesive thickness 344 between opposing surface 336 of second adherend 330 and bonding surface 326 of first adherend 320. Ceramic chip carrier 322 includes fluid channel 324 providing fluidic coupling between fluid in a reservoir (See FIG. 4) and fluid inlet channel 334 formed in silicon die 332. In alternate embodiments, ceramic chip carrier 322 may be a multilayer ceramic chip carrier (MCC) having micro-fluidic paths or channels providing fluidic coupling to particular fluid ejectors 350, as well as, electrical traces formed in various layers in the MCC providing electrical interconnections to silicon die 332.

In this embodiment, two-part adhesive 340 is a thermally cured two-part epoxy, however in alternate embodiments other two part adhesives such as polyurethanes, polynorbornenes, polysulfides and silicone adhesives, to name a few may also be utilized. Further in this embodiment two-part adhesive 340 is any non-ultraviolet curable adhesive. Adhesive thickness 344 is in the range from about 400 micrometers to about 700 micrometers, in this embodiment. However, in alternate embodiments, adhesive thickness may be in the range from about 25 microns to 250 microns depending on the particular application in which fluid ejector head 302 will be utilized. Further, in this embodiment adhesive bead 342 is dispensed on ceramic chip carrier 320, and two-part adhesive 340 has a viscosity in the range from about 50,000 to about 250,000 centipoise. As noted above depending on the particular application adhesive bead 342 may be dispensed on silicon die 332 as well. Adhesive bead 342 provides both a method of attachment and a fluid seal between silicon die 332 and ceramic chip carrier 320.

Silicon die 332 includes device surface 335 on which electronic components and electrical circuits are formed and opposing surface 336. In this embodiment, silicon die 332 includes one or more transistors or other logic devices (not shown) formed on device surface 335, however, "direct drive" structures may also be utilized in alternate embodiments. In a direct drive application each fluid ejector is electrically connected to a bond pad (not shown). In this embodiment, silicon die 332 is a silicon integrated circuit including transistors and other logic devices (not shown), however, materials such as germanium, gallium arsenide, amorphous silicon, polysilicon, and other substrates that support active and passive devices may also be utilized. In addition, silicon die 332 has fluid ejector actuators 350 formed on device surface 335.

As shown in FIG. 3, in this embodiment, fluid ejector actuators 350 are thermal resistors; however, other fluid ejectors may also be utilized such as piezoelectric, flex-tensional, acoustic, and electrostatic. Chamber layer 352 is formed on device surface 335 of silicon die 332, and forms fluidic chamber 356 around fluid ejector actuators 350, so that when fluid ejector actuators 350 are activated fluid is ejected out of nozzles 358, which are generally located over fluid ejector actuators 350. Fluid inlet channel 334 is formed in silicon die 332, and extends from opposing surface 336 to device surface 335. Fluid inlet channel 334 provides a fluidic path for fluid to fill fluidic chamber 356. Nozzle layer 354 is formed over chamber layer 352. Nozzle layer 354 may be formed of similar materials as described above for the embodiment shown in FIG. 2.

Figure 4:
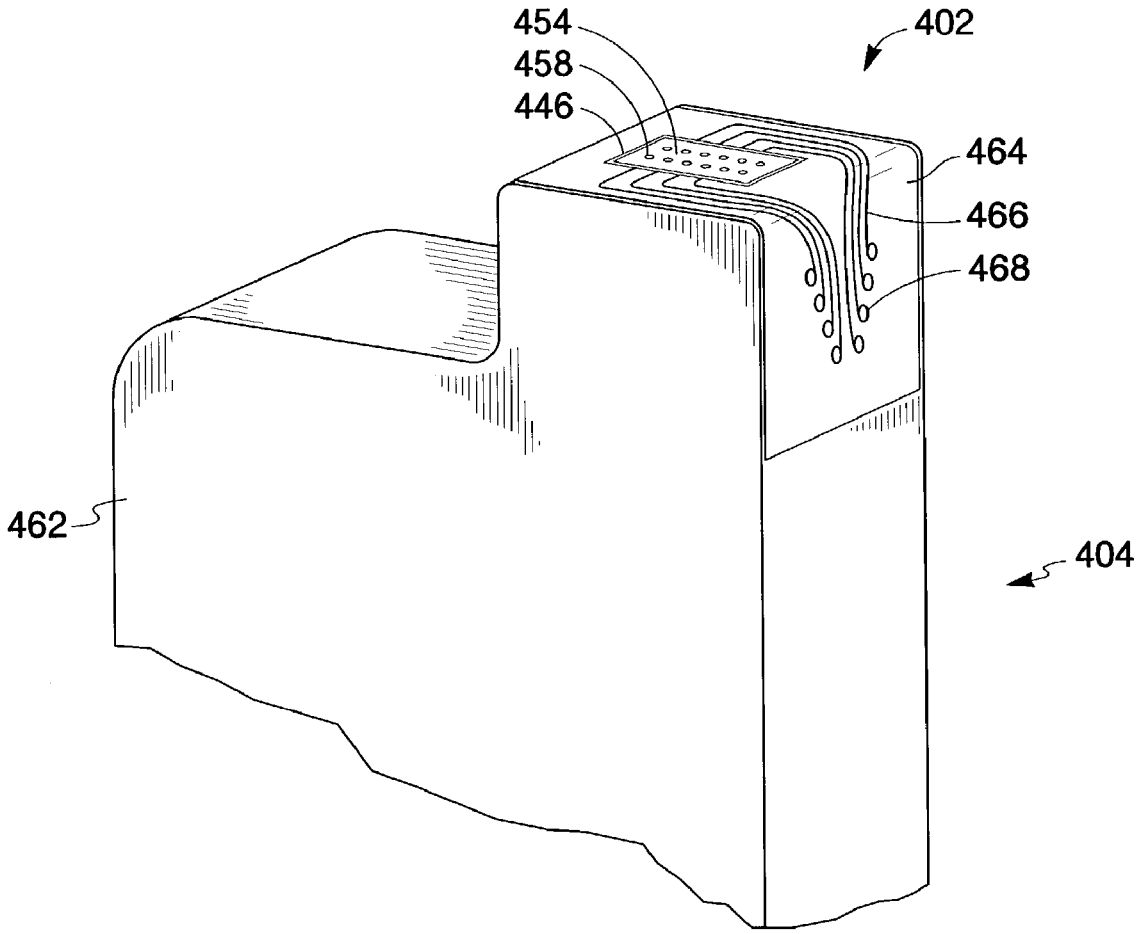
FIG. 4 is a perspective view of a portion of a fluid ejection cartridge according to an alternate embodiment of the present invention.

Referring to FIG. 4, an alternate embodiment of the present invention is shown in a simplified cross-sectional view. In this embodiment, fluid ejection cartridge 404 includes fluid reservoir 462 fluidically coupled to fluidic chambers (see, for example, FIGS. 2 and 3) in fluid ejector head 402. Nozzle layer 454 contains one or more nozzles 458 through which fluid is ejected. Ejector head 402 includes the substrate (not shown), nozzle layer 454, and nozzles 458.

In this embodiment, flexible circuit 464 is a polymer film and includes electrical traces 466 connected to electrical contacts 468. Electrical traces 466 are routed from electrical contacts 468 to bond pads on the silicon die or substrate (not shown) to provide electrical connection for the fluid ejection cartridge 404. Encapsulation beads 446 are dispensed along the edge of nozzle layer 454 and the edge of the substrate enclosing the end portion of electrical traces 466 and the bond pads on the substrate.

Figure 5:
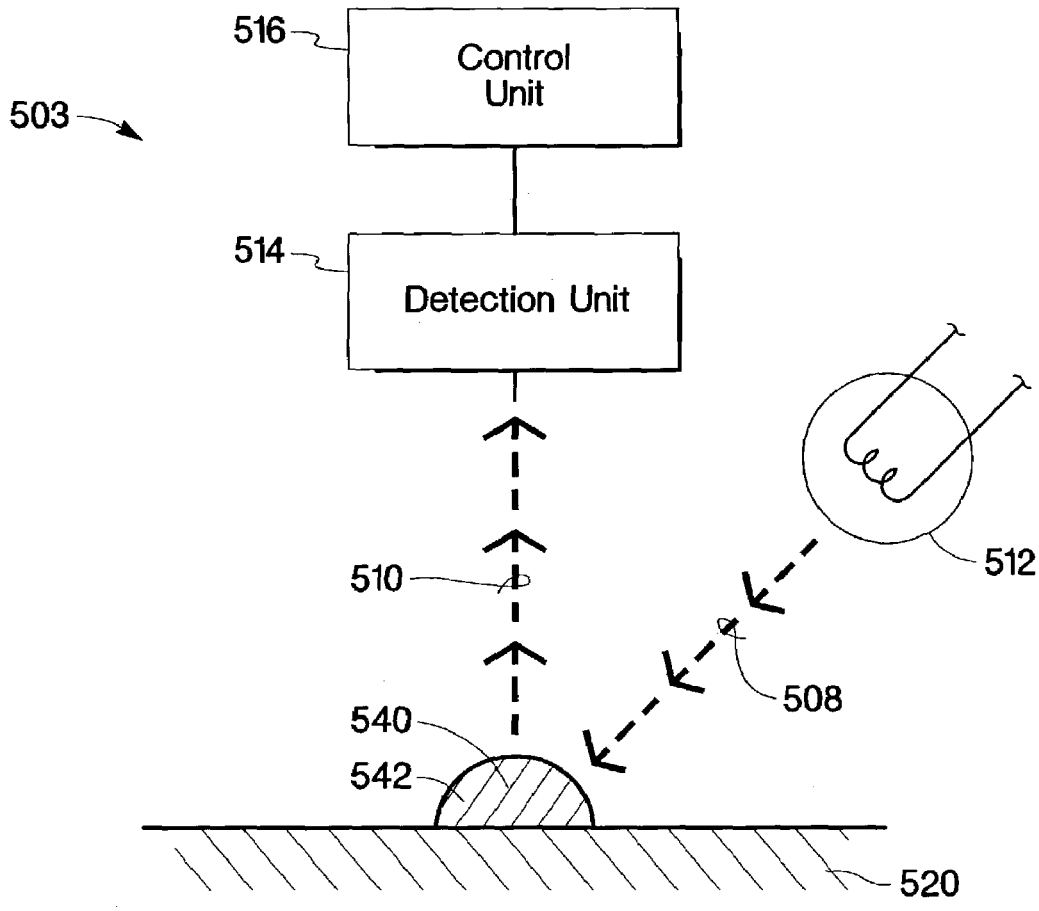
FIG. 5 is a cross-sectional view of an imaging and analysis system according to an alternate embodiment of the present invention.

Referring to FIG. 5 an exemplary embodiment of imaging and analysis system 503 utilized to determine the degree of mixing of the present invention is shown in a cross-sectional view. In this embodiment, imaging and analysis system 503 is manufactured by Kodak Inc. and sold under the name "Image Station 1000." Imaging and analysis system 503 includes UV light source 512 utilized to excite the fluorescent dye included in the two-part adhesive, and detection unit 514 that generates the fluorescent signal and control unit 516 that determines the degree of mixing. Detection unit 514 includes a thermoelectrically cooled full frame CCD (i.e. charge coupled device) camera. However, in alternate embodiments, other systems having a UV source and appropriate photodetector for the particular fluorescing dye used, may also be utilized. The detector or sensors, in alternate embodiments, may be of any desired form of photosensor that is adapted to receive light and convert it into a responsive output electrical signal.

In this embodiment, mixed two-part adhesive 540 is dispensed on first adherend 520 as adhesive bead 542. UV light source 512 emits UV beam 508 that illuminates or exposes at least a portion of adhesive bead 542 to ultraviolet light having a wavelength in the range from about 300 nanometers to about 400 nanometers. In alternate embodiments, UV light source 512 may operate in the wavelength range from about 200 nanometers to about 440 nanometers. UV exciting beam 508 excites the fluorescent dye (i.e. fluorophore molecules) in two-part adhesive 540 causing the molecules to emit a spectrum of fluorescent light at various angles or directions. Detector unit 514 senses the strength of the emitted fluorescent light from emitted beam 510. In this embodiment, various filters may also be arranged in front of the detector to filter out interfering light reflections which can arise from exciting beam 508 as it scatters off adhesive bead 542 or substrate 520. Detector unit 514 converts emitted beam 510 into an electrical signal representative of the intensity of the emitted photons from the fluorescent dye in two-part adhesive 540. The electrical signal is then processed by control unit 516 to generate a value representative of the degree of mixing or separate values representative of the accuracy of metering and the thoroughness of mixing of the first and second parts of two-part adhesive 540.

Figure 6:
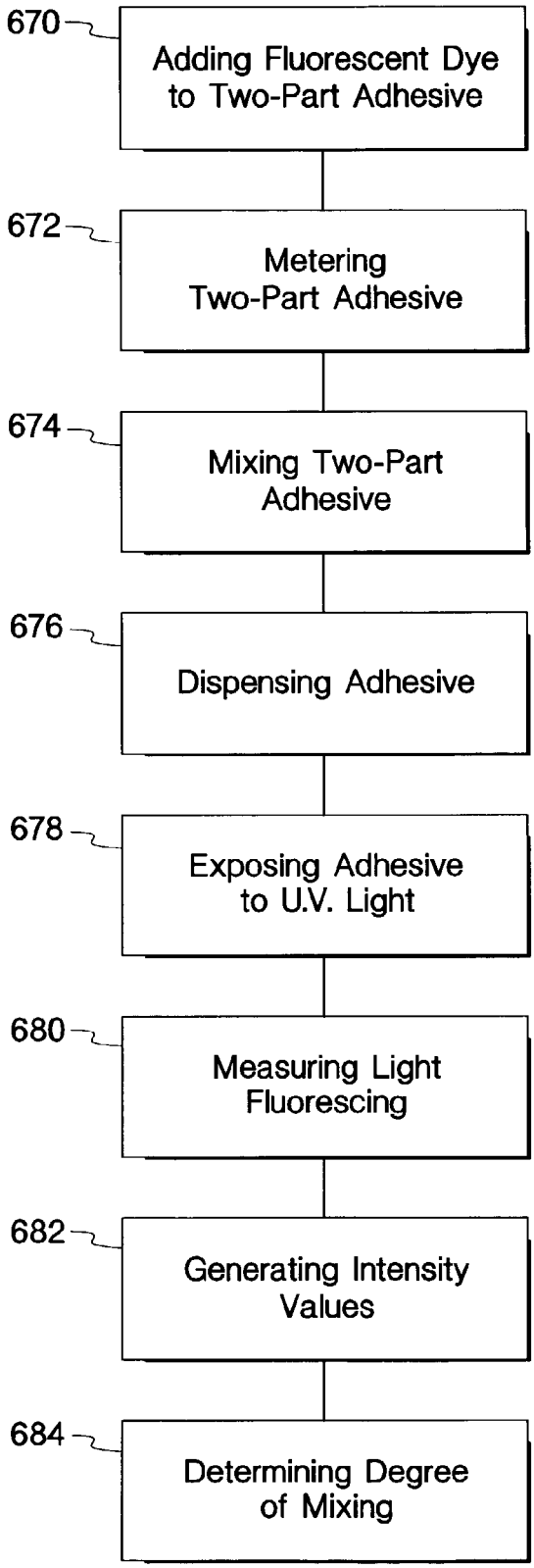
FIG. 6 is a flow diagram of a method of manufacturing an article of manufacture according to an embodiment of the present invention.

Referring to FIG. 6 a flow diagram of a method of manufacturing an article of manufacture according to an embodiment of the present invention is shown. Adding fluorescent dye to two-part adhesive process 670 includes adding a fluorescent dye to one part of the two-part adhesive. The particular fluorescent dye utilized will depend on various factors such as reactivity or lack thereof both to the part being added to as well as the part with which it will ultimately be mixed. For example, 1-naphthol fluorescent dye is compatible with an amine hardener, and thus, may be added to the "hardener part" of a two-part epoxy adhesive having such a hardener agent. Further the 1-naphthol fluorescent dye is also compatible with the resin since it is unreactive with the resin in the time between mixing and curing. In alternate embodiments, a second fluorescent dye may be added to the second part of the two-part adhesive. When two fluorescent dyes are utilized both the chemistry of the two-part adhesive should be considered, as well as, the peak in the emission curve as a function of wavelength should also be considered in selecting fluorescent dyes, so that the imaging system can separate at least a portion of the emission spectrum for analysis of each dye.

Figure 7:
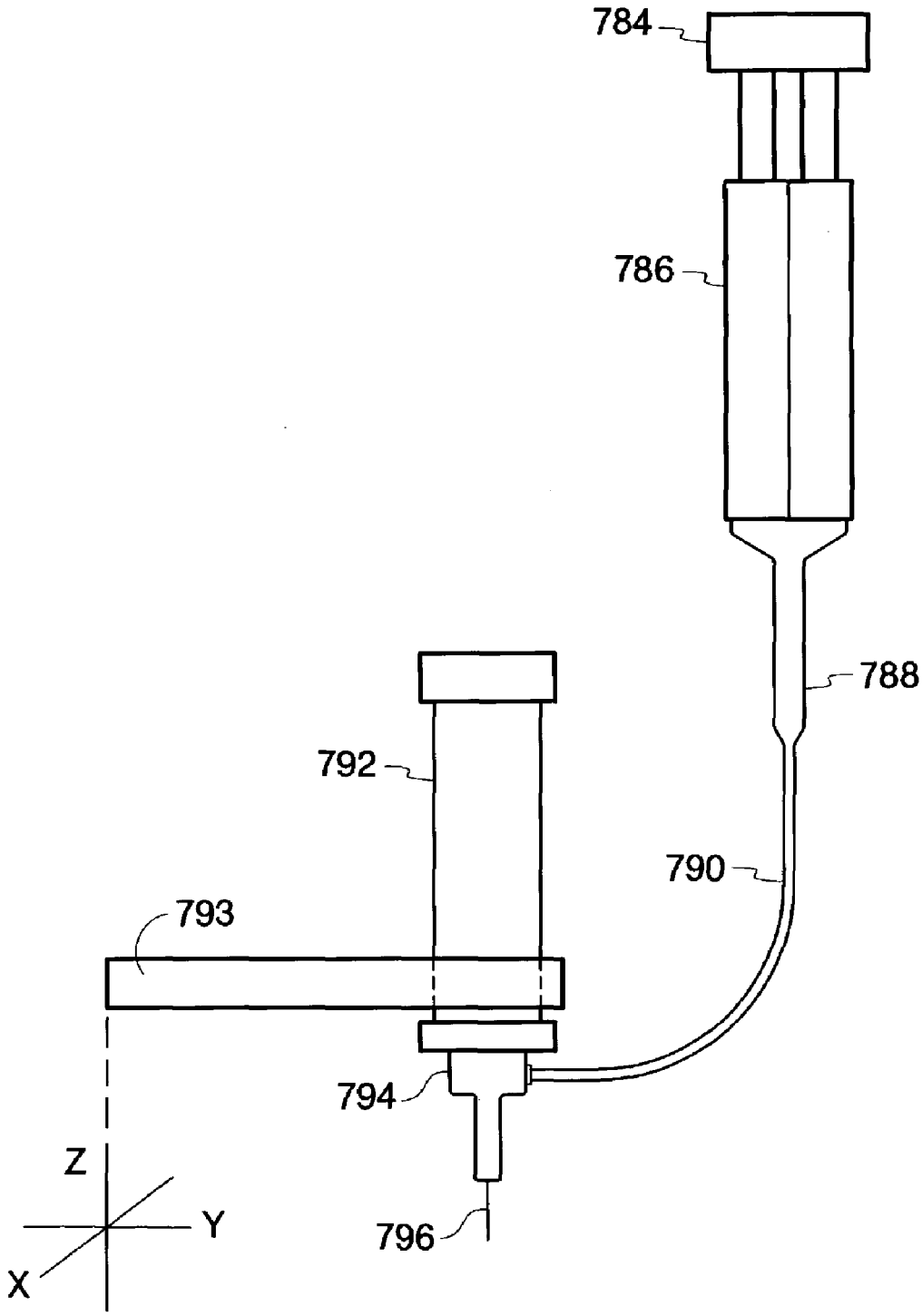
FIG. 7 is a plan view of a mixing and dispensing system according to an embodiment of the present invention.

Metering process 672 utilizes conventional techniques to meter the desired amount (i.e. weight or volume ratio) of the first and second parts of the two-part adhesive. For example, to meter a two-part epoxy, dual syringe package 786 may be utilized, which stores each part separately, as illustrated in FIG. 7. To meter the desired amount of each part, typically dual syringe package 786 is coupled to pneumatic plunger 784, which when activated urges the first and second parts contained in separate chambers in dual syringe package 786 out in a predetermined ratio. In this embodiment, a pressure of about 30 pounds per square inch is utilized to urge the desired amount of each part. However, in alternate embodiments, other pressures may also be utilized depending on the particular two-part adhesive being mixed and the particular mixer being utilized. In still other embodiments, many other methods may also be utilized such as separate containers coupled to gear pumps or a positive displacement pump to meter the two parts of the two-part adhesive.

Mixing process 674 utilizes conventional equipment to mix the first and second parts together. For example, to mix a two-part epoxy dual syringe package 786 is coupled to static mixer 788 as shown in FIG. 7. As material is urged out of dual syringe package 786 by pneumatic plunger 784 the material is forced through static mixer 788 and into tubing 790. In alternate embodiments, a dynamic mixer may also be utilized.

Dispensing process 676 also utilizes conventional equipment to dispense the mixed two-part adhesive onto the adherend. For example, after two-part adhesive is mixed it may be fed through tube 790 into disposable positive displacement pump 794 that is driven by drive motor 792. In this embodiment, tube 790 is nylon tubing, however, in alternate embodiments any tubing that is compatible with the two part adhesive being dispensed can be utilized such as metal tubing, or Teflon tubing as just a couple of examples. Positive displacement pump 794 and drive motor 792, in this embodiment, is a system obtained from Techcon Systems Inc. sold under the name DMP5000, utilizing a disposable positive displacement pump; however, any positive displacement pump and motor combination that can supply the desired flow rate of the mixed two part adhesive may also be utilized.

Needle 796 is coupled to the outlet portion of positive displacement pump 794. In this embodiment needle 796 has a diameter of about 0.13 inches, however, other needle diameters may also be utilized depending on the particular adhesive being dispensed as well as the particular application in which the two-part adhesive is being utilized. Drive motor 792 and positive displacement pump 794 is attached to an XYZ motion platform (not shown) via bracket 793. The XYZ motion platform provides the movement to dispense the two-part adhesive in the desired location and shape on the adherend. In this embodiment, a flow rate of 10 micro Liters per second is utilized, and the linear XY speed was, during dispensing process 676, 1.5 inches per minute. However, in alternate embodiments, any flow rate and linear speed combination may be utilized depending on the particular adhesive being used, and the particular geometrical shape or two-dimensional pattern and accuracy of the dispensed adhesive desired.

Although tubing 790 is utilized to couple static mixer 788 to positive displacement pump 794 as shown in FIG. 7, in alternate embodiments, dispensing process 676 may utilize static mixer 788 connected directly to positive displacement pump 794 reducing the volume of mixed adhesive used, and providing a reduced residence time of the mixed adhesive in the dispensing system. The latter is advantageous for two-part adhesives having a short pot life. In still other embodiments a dual inlet positive displacement pump may also be utilized in dispensing process 676, providing a further reduction in the volume of mixed adhesive utilized, as well as, facilitating the use of two-part adhesives having an even shorter pot life.

Exposing process 678 utilizes any conventional UV source capable of exciting the fluorescent dye. In exposing process 678 the UV light source emits a UV beam that exposes at least a portion of the dispensed adhesive bead to ultraviolet light having a wavelength in the range from about 200 nanometers to about 440 nanometers. For example the Kodak Image Station 1000 utilizes four lamps configured for epi-illumination emitting in the range from about 300 nanometers to about 400 nanometers. The UV beam excites the fluorescent dye (i.e. fluorophore molecules) in the mixed two-part adhesive causing the molecules to emit a spectrum of fluorescent light in various directions. Depending on the particular fluorescent dye or dyes mixed with the two-part adhesive other wavelength ranges may be also be utilized. In addition, various filters such as bandpass or notch filters may also be utilized.

Measuring fluorescing light process 680 utilizes a detector unit that senses the strength of the emitted fluorescent light from the exposed portion of the adhesive bead. As with the UV light source, various filters may also be arranged in front of the detector to filter out interfering light reflections which can arise from exciting UV beam as it scatters off either the adhesive bead or the adherend itself or both. For example the Kodak Image Station 1000 utilizes a 10× 16–160 millimeter f2.0 zoom lens for collecting the emitted fluorescent light. In alternate embodiments various other lens systems and cameras may be utilized depending on various parameters such as the particular fluorescent dye fluorescing, the size of the adhesive bead, and the possible presence of other UV fluorescers either in the two-part adhesive or the adherend that may interfere to name just a few.

Generating intensity values process 682 utilizes any of a number of conventional photoelectric conversion technologies. For example, the Kodak Image Station 100 utilizes a thermoelectrically cooled CCD camera with a resolution of 1024×1024 pixels. In alternate embodiments, various other detector technologies may also be utilized such as photodiodes or phototransistors having the appropriate wavelength range to convert the emitted fluorescing light intensity to an electrical signal.

Determining the degree of mixing process 684 utilizes a control unit to amplify and digitize the fluorescent intensity signal. The control unit is coupled to a standard computer providing the ability to carry out further image analysis. Whether generating a value representing the degree of mixing or separately determining the accuracy of metering and the thoroughness of mixing, a sample of known quantity is first prepared to compare the fluorescence intensity of the known sample to an actual production sample of unknown quantity. For example, if a single fluorescent dye is added to one part of the two-part adhesive, the appropriate ratio of the first and second parts, including one part having the fluorescent dye, are accurately metered and then mixed and dispensed on either a real sample or a blank test sample. Then multiple measurements on the same sample, as well as, measurements on multiple samples are taken. To derive the degree of mixing, a root mean square (rms) value is calculated by averaging the intensity value of all of the pixels from the each image of the complete adhesive bead dispensed on a particular standard sample to generate a net intensity for that particular sample. Then the net intensity for each standard value is determined to generate an average standard fluorescing signal intensity. The ratio of the fluorescing signal intensity of a production part and the standard intensity value is determined to provide a measured value of the degree of mixing of the two parts mixed in the production part. If it is desired to separate out the metering accuracy from the mixing thoroughness then the intensity values of the pixels are averaged as just described and the intensity value of a number of pixels are also averaged to generate a localized intensity value representative of a local area of the adhesive bead. For example, if the entire adhesive bead just covers the field of view so that each pixel of the CCD camera represents a localized amount of the adhesive dispensed, then just for illustrative purposes only, a 1 centimeter by 1 centimeter adhesive bead utilizing 1000 pixels by 1000 pixels provides a 20 micrometer by 20 micrometer square localized net intensity value, when the appropriate groups of 2×2 pixels are averaged together. Various averaging algorithms may be used to obtain a variety of localized intensity values to measure the mixing thoroughness. In addition, multiple images at different magnification can also be utilized and combined with the various averaging algorithms to generate even more localized intensity values depending on the size and shape of the adhesive bead dispensed.

For a two-dye system the appropriate ratio of the first and second parts, including the two fluorescent dyes, are accurately metered, mixed, and dispensed and then a standard fluorescing signal intensity for each dye is obtained as described above. The ratio of the fluorescing signal intensity of each production part and the corresponding value for that dye in the standard is determined to provide a measured value of the actual ratio of the two parts mixed in the production part as well as the thoroughness of mixing. By utilizing one or two fluorescent dyes in a two-part adhesive a method of determining whether a properly mixed adhesive has been dispensed before subjecting the part to curing not only enables reworking of those parts containing improperly metered or mixed adhesive before curing but also provides for improved reliability in bondline strength.

The following example illustrates the process of utilizing a fluorescent dye to determine the degree of mixing of the parts mixed in a two-part adhesive, which may be used according to the present invention. The present invention, however, is not limited to this example.

EXAMPLE 1

Standard samples: Six standards were prepared, using a two-part epoxy adhesive, by weighing each part of the two-part epoxy in a 1:4 ratio of hardener to resin and then mixing as described above. The two-part adhesive included a first part (i.e. the hardener) having an amine hardener, including a 0.1% by weight 1-naphthol fluorescent dye and a second part (i.e. the resin) having a diglycidyl ether of a bisphenol alcohol resin, and glass beads. The mixed adhesive was dispensed on aluminum oxide ceramic substrates as an adhesive bead in an oval form having a length approximately 25 millimeters and a width of approximately 4 millimeters. The adhesive bead was approximately 1 millimeters wide and 600 micrometers thick.

After the mixed two-part adhesive was dispensed on six ceramic substrates, the standards were grouped as a set of 6 samples and imaged together utilizing the Kodak Image Station 1000 system, using broad UV illumination for 6.25 seconds with a blue emission filter. Each group was imaged at least 4 times and each image was taken approximately 2 minutes apart. The region of interest was set to cover the entire oval bead area on each ceramic substrate. The net intensity, mean, and background of each region of interest were determined. The net intensity measurements of each standard were averaged to obtain a mean standard intensity value.

Six samples having a ratio of 0.9:4 of hardener to resin were then prepared and analyzed using the same procedure outlined above for the standards.

Six samples having a ratio of 1.1:4 of hardener to resin were also prepared and analyzed using the same procedure outlined above for the standards.

Figure 8:
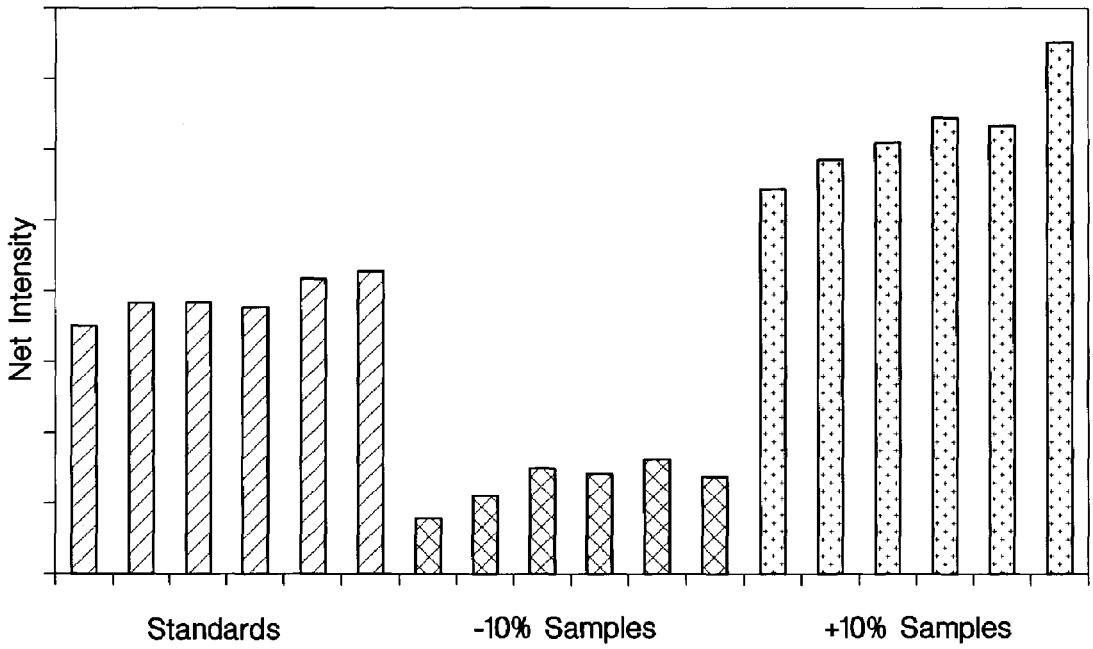
FIG. 8 is a bar graph illustrating the change in intensity as a function of the degree of mixing of a two-part adhesive according to an embodiment of the present invention.

The results of these measurements are summarized in the form of a bar graph, as shown in FIG. 8, illustrating the relative change in net intensity measured as the degree of mixing of the two parts mixed together is varied. As can be seen from the graph shown in FIG. 8 changes in the degree of mixing of the two parts of the order of 10 percent are discernable and that even changes less than 5 percent would also be observable.

What is claimed is:

1. An article of manufacture, comprising:

a first adherend;

a mixed, non-ultraviolet curable two-part adhesive disposed on said first adherend, wherein the first part of the two part adhesive includes a first fluorescent dye.

2. The article of manufacture in accordance with claim 1, wherein upon exposure to ultraviolet light said first fluorescent dye generates a fluorescent signal providing a degree of mixing value of said mixed two-part adhesive.

3. The article of manufacture in accordance with claim 1, wherein upon exposure to ultraviolet light said first fluorescent dye generates a fluorescent signal providing an accuracy of metering value of said mixed two-part adhesive.

4. The article of manufacture in accordance with claim 1, wherein upon exposure to ultraviolet light said first fluorescent dye generates a fluorescent signal providing a thoroughness of mixing value of said mixed two-part adhesive.

5. The article of manufacture in accordance with claim 1, wherein said fluorescent dye is non-reactive to the second part of said two part adhesive.

6. The article of manufacture in accordance with claim 1, wherein the second part of said two-part adhesive further comprises a second fluorescent dye different from said first fluorescent dye.

7. The article of manufacture in accordance with claim 1, wherein said first and said second fluorescent dyes each further comprises an emission curve having a peak separately detectable from each other.

8. The article of manufacture in accordance with claim 1, wherein said first fluorescent dye is 1-naphthol or 2-naphthol.

9. The article of manufacture in accordance with claim 1, wherein said first fluorescent dye is an inorganic fluorescer.

10. The article of manufacture in accordance with claim 1, wherein said two-part adhesive is selected from the group consisting of a two-part epoxy adhesive, a two-part silicone adhesive, a two-part urethane adhesive, a two-part polysulfide adhesive, a two-part polynorbornene adhesive, or mixtures thereof.

11. The article of manufacture in accordance with claim 1, wherein said two-part adhesive further comprises a thermally cured two-part adhesive.

12. The article of manufacture in accordance with claim 1, wherein said two-part adhesive further comprises a two-part adhesive having a viscosity in the range from about 50,000 to about 250,000 centipoise.

13. The article of manufacture in accordance with claim 1, wherein said two-part adhesive has a thickness in the range from about 200 micrometers to about 1000 micrometers.

14. The article of manufacture in accordance with claim 1, wherein said two-part adhesive has a thickness in the range from about 10 micrometers to about 1000 micrometers.

15. The article of manufacture in accordance with claim 1, wherein said two-part adhesive has a thickness in the range from about 400 micrometers to about 700 micrometers.

16. The article of manufacture in accordance with claim 1, wherein said two-part adhesive has a thickness in the range from about 25 micrometers to about 250 micrometers.

17. The article of manufacture in accordance with claim 1, wherein said two-part adhesive further comprises an amount of said first fluorescent dye added to the first part of said two-part adhesive in the range from about 0.001 weight percent to about 1.0 weight percent.

18. The article of manufacture in accordance with claim 1, wherein said two-part adhesive further comprises an amount of said first fluorescent dye added to the first part of said two-part adhesive in the range from about 0.01 weight percent to about 0.5 weight percent.

19. The article of manufacture in accordance with claim 1, wherein said two-part adhesive is an encapsulant.

20. The article of manufacture in accordance with claim 19, wherein said encapsulant further comprises a material providing moisture and corrosion protection to an electrical interconnection.

21. The article of manufacture in accordance with claim 1, wherein said first adherend or said second adherend further comprises an active device disposed thereon.

22. The article of manufacture in accordance with claim 1, wherein said first adherend further comprises a chip carrier.

23. The article of manufacture in accordance with claim 22, wherein said chip carrier further comprises a ceramic chip carrier.

24. The article of manufacture in accordance with claim 23, wherein said ceramic chip carrier further comprises a multilayer ceramic chip carrier having micro-fluidic channels formed therein.

25. The article of manufacture in accordance with claim 1, wherein said second adherend further comprises a silicon die.

26. The article of manufacture in accordance with claim 25, wherein said silicon die further comprises at least one fluid ejector actuator.

27. A fluid ejector head comprising an article of manufacture of claim 25.

28. A fluid ejector cartridge, comprising:

at least one fluid ejector head of claim 27; and at least one fluid reservoir fluidically coupled to said fluid ejector head.

29. An article of manufacture, comprising:

a first adherend;

a mixed two-part adhesive dispensed on said first adherend;

means for fluorescently determining a degree of mixing value of said mixed two-part adhesive; and a second adherend in contact with said mixed two-part adhesive.

30. The article of manufacture in accordance with claim 29, wherein said degree of mixing further comprises means for generating an accuracy of metering value.

31. The article of manufacture in accordance with claim 29, wherein said degree of mixing further comprises means for generating a thoroughness of mixing value.

32. The article of manufacture in accordance with claim 29, wherein said first adherend or second adherend further comprises means for ejecting a fluid.

33. The article of manufacture in accordance with claim 32, further comprises means for storing said fluid.

34. A method of making an article of manufacture, comprising:

dispensing a two-part adhesive on a first adherend;

exposing said dispensed two-part adhesive to ultraviolet light;

causing a first fluorescent dye in said dispensed two-part adhesive to fluoresce;

measuring light emitted from at least a portion of said dispensed two-part adhesive;

determining a first intensity value of said measured light emitted from said two-part adhesive; and generating a degree of mixing value.

35. The method in accordance with the method of claim 34, wherein generating said degree of mixing value further comprises generating accuracy of metering value.

36. The method in accordance with the method of claim 34, wherein generating said degree of mixing value further comprises a thoroughness of mixing value.

37. The method in accordance with the method of claim 36, wherein generating said thoroughness of mixing value further comprises:

averaging the intensity value of a number of pixels; and generating a localized intensity value representative of a local area of said dispensed two-part adhesive on said first adherend.

38. An article of manufacture manufactured in accordance with the method of claim 37.

39. The method in accordance with the method of claim 36, wherein generating said thoroughness of mixing value further comprises taking a higher resolution image of at least a portion of said dispensed two-part adhesive on said first adherend.

40. The method in accordance with the method of claim 34, wherein generating said degree of mixing value further comprises dividing said first intensity value by a second intensity value, whereby said degree of mixing is determined.

41. The method in accordance with the method of claim 40 wherein said second intensity value further comprises a predetermined standard value.

42. The method in accordance with the method of claim 34, wherein exposing said dispensed two-part adhesive to ultraviolet light further comprises exposing said dispensed two-part adhesive to ultraviolet light in the range from about 200 nanometers to about 440 nanometers.

43. The method in accordance with the method of claim 34, wherein exposing said dispensed two-part adhesive to ultraviolet light further comprises exposing said dispensed two-part adhesive to ultraviolet light in the range from about 300 nanometers to about 400 nanometers.

44. The method in accordance with the method of claim 34, further comprising metering the first part including said first fluorescent dye and the second part in a predetermined ratio.

45. The method in accordance with the method of claim 34, further comprising mixing the first part including said first fluorescent dye and the second part of said two-part adhesive together.

46. The method in accordance with the method of claim 45, wherein mixing the first part and the second part further comprises mixing the first and second parts utilizing a dual inlet positive displacement pump.

47. The method in accordance with the method of claim 34, further comprising mixing the first part including said first fluorescent dye and the second part including a second fluorescent dye together.

48. The method in accordance with the method of claim 47, further comprising:

causing said second fluorescent dye in said dispensed two-part adhesive to fluoresce;

measuring light emitted, from said second fluorescent dye, from at least a portion of said dispensed two-part adhesive;

determining said second intensity value of said measured light emitted from said second fluorescent dye; and generating a degree of mixing from the ratio of said first intensity value and said second intensity value.

49. An article of manufacture manufactured in accordance with the method of claim 48.

50. The method in accordance with the method of claim 48, wherein generating said degree of mixing value further comprises generating an accuracy of metering value.

51. The method in accordance with the method of claim 48, wherein generating said degree of mixing value further comprises generating a thoroughness of mixing value.

52. The method in accordance with the method of claim 34, wherein dispensing said two-part adhesive further comprises dispensing a two-part adhesive having a first fluorescent dye, non-reactive to other components of said first part of said two-part adhesive.

53. The method in accordance with the method of claim 34, wherein dispensing said two-part adhesive further comprises dispensing a two-part adhesive selected from the group consisting of a two-part epoxy adhesive, a two-part silicone adhesive, a two-part urethane adhesive, a two-part polysulfide adhesive, a two-part polynorbornene adhesive, or combinations thereof.

54. The method in accordance with the method of claim 34, wherein dispensing said two-part adhesive further comprises dispensing a non-ultraviolet curable two-part adhesive.

55. The method in accordance with the method of claim 34, wherein dispensing said two-part adhesive further comprises dispensing a two-part adhesive having a viscosity in the range from about 50,000 to about 250,000 centipoise.

56. The method in accordance with the method of claim 34, wherein dispensing said two-part adhesive further comprises dispensing a two-part adhesive having a thickness in the range from about 10 micrometers to about 1000 micrometers.

57. An article of manufacture manufactured in accordance with the method of claim 34.

58. The method in accordance with the method of claim 34, wherein dispensing said two-part adhesive further comprises dispensing a two-part adhesive on a silicon die.

59. The method in accordance with the method of claim 34, wherein dispensing said two-part adhesive further comprises dispensing a two-part adhesive on a fluid ejection cartridge body.

60. The method in accordance with the method of claim 34, wherein dispensing said two-part adhesive further comprises dispensing a two-part adhesive on a ceramic chip carrier.

61. The method in accordance with the method of claim 34, further comprising contacting a second adherend to said dispensed two-part adhesive on said first adherend.

62. The method in accordance with the method of claim 34, wherein measuring light emitted further comprises measuring light emitted utilizing a detector that senses the strength of the emitted light.

63. The method in accordance with the method of claim 62, wherein said detector further comprises a lens system.

64. The method in accordance with the method of claim 63, wherein said lens system further comprises a charge coupled device camera.

65. The method in accordance with the method of claim 34, wherein dispensing said two part adhesive further comprises dispensing said two-part adhesive in a two dimensional pattern.

66. The method in accordance with the method of claim 34, wherein dispensing said two part adhesive further comprises dispensing said two-part adhesive utilizing an XYZ motion platform.

67. A method of making an article of manufacture, comprising:

mixing a first part including a fluorescent dye and a second part of a two-part adhesive;

dispensing a two-part adhesive on a first adherend;

exposing said dispensed two-part adhesive to ultraviolet light;

causing a first fluorescent dye in said dispensed two-part adhesive to fluoresce;

measuring light emitted from at least a portion of said dispensed two-part adhesive;

determining a first intensity value of said measured light emitted from said two-part adhesive;

generating a degree of mixing value;

generating a value representative of an accuracy of metering;

generating a value representative of a thoroughness of mixing; and contacting a second adherend to said dispensed two-part adhesive on said first adherend.

68. An article of manufacture, comprising:

a first adherend;

a two-part non-ultraviolet light curable epoxy adhesive mixed and dispensed on said first adherend, wherein the first part of the two part adhesive includes a first fluorescent dye in the range from about 0.01 weight percent to about 0.5 weight percent, said first fluorescent dye generates an emitted light intensity from said two-part non-ultraviolet light curable epoxy adhesive, providing a value of a degree of mixing between the first and the second part of said two-part non-ultraviolet light curable epoxy adhesive; and a second adherend in contact with said two-part non-ultraviolet light curable epoxy adhesive.

* * * * *